US009669454B2

(12) United States Patent
Bode

(10) Patent No.: US 9,669,454 B2
(45) Date of Patent: Jun. 6, 2017

(54) HOLDING DEVICE FOR A FLANGING TOOL AND FLANGING TOOL FOR FLANGING PIPE ENDS

(75) Inventor: Olaf Bode, Bad Camberg (DE)

(73) Assignee: ROTHENBERGER AG, Kelkheim (DE)

( * ) Notice: Subject to any disclaimer, the term of this patent is extended or adjusted under 35 U.S.C. 154(b) by 390 days.

(21) Appl. No.: 13/885,405

(22) PCT Filed: Jan. 20, 2012

(86) PCT No.: PCT/DE2012/100014

§ 371 (c)(1),
(2), (4) Date: May 15, 2013

(87) PCT Pub. No.: WO2012/107030

PCT Pub. Date: Aug. 16, 2012

(65) Prior Publication Data

US 2014/0033784 A1 Feb. 6, 2014

(30) Foreign Application Priority Data

Feb. 9, 2011 (DE) ..... 10 2011 000 580

(51) Int. Cl.
*B21D 41/02* (2006.01)

(52) U.S. Cl.
CPC ..... *B21D 41/021* (2013.01)

(58) Field of Classification Search
CPC ..... B21D 19/00; B21D 41/02; B21D 41/021
USPC ..... 72/117, 316, 317, 322, 409.18
See application file for complete search history.

(56) References Cited

U.S. PATENT DOCUMENTS

| | | | | |
|---|---|---|---|---|
| 2,711,576 | A * | 6/1955 | Wilson | B21D 41/023 269/127 |
| 2,853,116 | A * | 9/1958 | Wilson | B21D 41/021 279/14 |
| 2,948,326 | A * | 8/1960 | Ingwer et al. | 72/116 |
| 3,218,837 | A * | 11/1965 | Wilson | 72/317 |
| 3,748,886 | A | 7/1973 | Wolcott | |
| 7,954,356 | B1 * | 6/2011 | Erbrick et al. | 72/409.12 |
| 2006/0117827 | A1 | 6/2006 | Kao | |

FOREIGN PATENT DOCUMENTS

| | | |
|---|---|---|
| DE | 2358202 A1 | 5/1975 |
| DE | 20107279 U1 | 8/2001 |

* cited by examiner

*Primary Examiner* — Shelley Self

(57) ABSTRACT

A holding device for a flanging tool includes two clamping parts movable towards one another to respective clamping positions. A stop is configured to abut, in an abutment position, an end of a pipe to be flanged. An actuating mechanism is configured to move the clamping parts into the respective clamping positions so as to clamp the pipe to be flanged. The actuating mechanism is coupled to the stop such that actuation of the actuating mechanism moves the stop out of the abutment position.

20 Claims, 5 Drawing Sheets

HOLDING DEVICE FOR A FLANGING TOOL AND FLANGING TOOL FOR FLANGING PIPE ENDS

CROSS-REFERENCE TO PRIOR APPLICATIONS

This application is a U.S. national phase application under 35 U.S.C. §371 of International Application No. PCT/DE2012/100014 filed on Jan. 20, 2012 and claims benefit to German Patent Application No. DE 10 2011 000 580.3, filed on Feb. 9, 2011. The international application was published in German on Aug. 16, 2012, as WO 2012/107030 A1 under PCT Article 21(2).

FIELD

The invention relates to a holding device for a flanging tool which serves for fastening a pipe which is to be flanged. The invention furthermore relates to a flanging tool for flanging pipe ends.

BACKGROUND

Flanging tools for flanging pipe ends widen the end region of a pipe by means of deformation. Flanging of the end region is used for example in the production of detachable pipe joints in refrigeration engineering. For this, usually copper pipes are provided with a special union nut, and then the pipe end is flanged and thus a flared flange is produced. The union nut and the flared flange mean that the pipe can be screwed against a counter-element without additional sealing means.

The flanging tools usually have a holding device by means of which the pipe which is to be flanged is received and chucked. Usually, alignment relative to the flanging tool additionally takes place during the course of the chucking of the pipe which is to be flanged. If the pipe to be flanged is aligned and chucked in the holding device, then the flanging tool is moved against that end of the pipe which is to be flanged and widening is effected by the pressure of the flanging tool against the pipe end. The holding device and the flanging tool are usually operated manually.

Flanging tools of this type with a holding device for the pipe which is to be flanged of this type are known from DE 201 07 279 U1 and DE 23 58 202 A1.

SUMMARY

In an embodiment, the present invention provides a holding device for a flanging tool. The holding device includes two clamping parts movable towards one another to respective clamping positions. A stop is configured to abut, in an abutment position, an end of a pipe to be flanged. An actuating mechanism is configured to move the clamping parts into the respective clamping positions so as to clamp the pipe to be flanged. The actuating mechanism is coupled to the stop such that actuation of the actuating mechanism moves the stop out of the abutment position.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
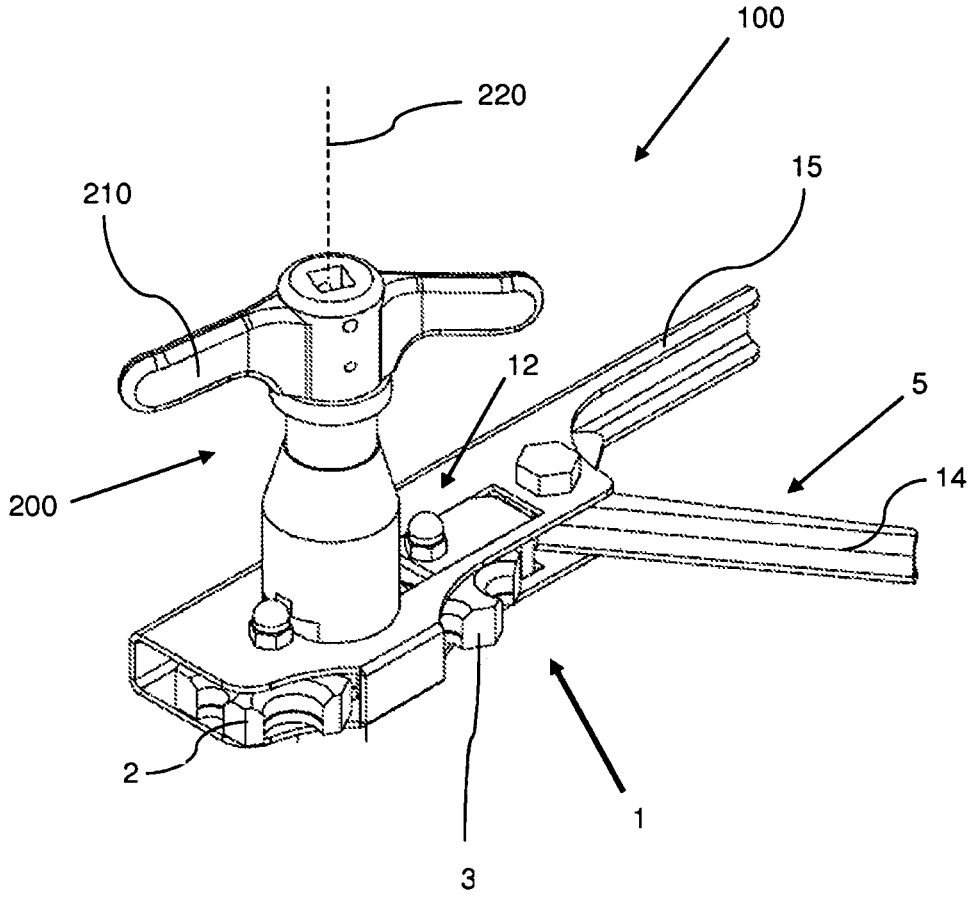
FIG. 1 shows a possible embodiment of a flanging tool for flanging pipe ends with a possible embodiment of a holding device for holding the pipe which is to be flanged, in a perspective view.

In an embodiment, the invention provides a holding device for a flanging tool with the features referred to at the outset which is simple to operate, permits rapid chucking of the pipe which is to be flanged and brings the pipe which is to be flanged into a specific machining position with simple manipulation. Further, a flanging tool for flanging pipe ends which is suitable for such a holding device is to be provided.

A holding device according to an embodiment of the invention for a flanging tool which serves to fasten a pipe which is to be flanged has two clamping parts which are movable towards one another, between which the pipe to be flanged can be clamped. The pipe to be flanged can be held in a desired position by the clamping parts. Also the pipe can be clamped by means of the clamping parts to such an extent that the pipe is secured counter to the force of a flanging tool which acts on the end of the pipe.

The holding device according to an embodiment of the invention further has a stop, against which the pipe to be flanged can be brought into abutment with the end thereof which is to be flanged. Owing to the stop, the pipe to be flanged can be brought into a specific machining position, in which the flanging operation can be carried out optimally by means of a flanging tool. Owing to the stop, the pipe to be flanged can be brought into the specific machining position quickly and in a simple manner.

The holding device according to an embodiment of the invention furthermore has an actuating mechanism by means of which the clamping parts can be brought into a clamping position against the pipe to be flanged. Owing to the actuating mechanism, simple and rapid operation of the holding device is achieved in order to be able to chuck the pipe which is to be flanged between the clamping parts.

According to an embodiment of the invention, provision is further made for the actuating mechanism to be coupled to the stop, so that by actuation of the actuating mechanism the stop can be brought out of its abutment position relative to the pipe which is to be flanged.

This measure results in simple manipulation of the holding device, since a plurality of components of the holding device can be actuated by means of the one actuating mechanism. On the one hand, the clamping parts, by means of the actuating mechanism, can be brought into their clamping position relative to the pipe which is to be flanged. On the other hand, the stop can be moved out of its abutment position relative to the pipe which is to be flanged by means of the same actuating mechanism.

Owing to the holding device according to the invention, the pipe to be flanged can be received and clamped quickly with simple manipulation in a user-friendly manner, with at the same time rapid alignment of the pipe which is to be flanged into a specific machining position being made possible by means of the stop.

According to one embodiment of the invention, provision is made for the actuating mechanism to be coupled, in particular mechanically coupled, to the stop in such a way that by actuation of the actuating mechanism the stop is brought out of its abutment position relative to the pipe which is to be flanged.

The stop is thereby automatically moved out of its abutment position preferably to such an extent that a flanging tool can then act on that end of the pipe which is to be flanged, without the stop disrupting the deformation operation.

According to a further embodiment of the invention, provision is made for the clamping parts to form a female mould for that end of the pipe which is to be flanged, access to the female mould being unblocked by the stop in the clamping position of the clamping parts. This makes possible deformation of the pipe which is to be flanged by means of a flanging tool which acts against the female mould without disruption by the stop.

It is advisable for the stop to be in an operative connection, in particular to be mechanically coupled, to one of the clamping parts, so that upon a movement of the clamping parts towards each other the stop at least partially moves with them. This means that the stop can be brought into its abutment position relative to the pipe which is to be flanged and can also be brought out of it again in a technically simple manner, so that disruption-free flanging by means of the flanging tool is made possible. Preferably, the stop should be mechanically coupled to one of the clamping parts such that upon a movement of the clamping parts towards each other the stop at least partially moves with them and is brought out of the abutment position.

Preferably, owing to the movement of the stop out of the abutment position, access to that end of the pipe which is to be flanged, in particular to the female mould formed by the clamping parts, should be unblocked by the stop.

Owing to the coupling of the movement of the stop with one of the clamping parts, it can be ensured that when the clamping parts are brought mutually together the stop is automatically moved out of its abutment position, and at the same time when the clamping parts are moved away from each other the stop is again brought into its abutment position. The stop, during the operation of threading-in the pipe which is to be flanged between the clamping parts, is thereby in a position to bring the pipe into abutment against the stop. Upon flanging the end of the pipe by means of the flanging tool, the stop is moved out of its abutment position into an end position in which the flanging tool has free access to the end of the pipe.

It is advisable to couple the movement of the stop and clamping part together such that the stop only unblocks the abutment position or the access to the female mould when the pipe to be flanged is held non-detachably in the holding unit by the clamping force of the clamping parts.

According to a preferred embodiment of the invention, provision is made that one of the clamping parts can be moved translationally relative to a section which is fixed relative to the housing. This means that the clamping parts in a technically particularly simple manner can be brought towards each other into the clamping position relative to the pipe which is to be flanged, in that the one clamping part is moved translationally towards the other clamping part.

Preferably the clamping part which can be moved translationally is forcibly guided on the section which is fixed relative to the housing. This achieves reliable movement of the one clamping part in the direction of the other clamping part on a specific, desired path of movement, so that once the pipe which is to be flanged has been threaded into a gap between the clamping parts which have been brought away from each other, the clamping parts can be brought towards each other in a reliable manner in the clamping position relative to the pipe which is to be flanged.

Preferably, the forcible guidance is realised by a sliding-block guide which is formed by the section which is fixed relative to the housing and the clamping part which is movable thereon, optionally with the interposition of further components of the holding device.

It is advisable for the stop to be pivotably mounted. This means that the stop can be brought into its abutment position and can also be brought out of the abutment position again in a particularly simple manner. It is furthermore advisable for the stop to be mounted pivotably on the one clamping part, which is formed to be movable, in particular can be moved translationally, towards the other clamping part.

According to a further embodiment of the invention, provision is made for the actuating mechanism to have an actuating element which can be actuated manually and which acts on at least one of the clamping parts and/or the stop. This means that the one clamping part or the stop is movable in a technically simple manner.

Provision may be made for the stop and at least one of the clamping parts to cooperate with the actuating element via at least one intermediate member.

Provision may furthermore be made for the stop and at least one of the clamping parts to cooperate with the actuating element via a common intermediate member. Owing to the common intermediate member, coupling of the movement of the stop and the one clamping part is realised in a technically simple manner.

If an intermediate member is provided, it is advisable that the intermediate member can be moved translationally relative to a section which is fixed relative to the housing, in particular is forcibly guided on the section which is fixed relative to the housing. Such a forcible guidance means may be a sliding-block guide, which is formed for example by the section which is fixed relative to the housing and the intermediate member. Owing to the movability of the intermediate member along a forcibly-guided, specific path of movement, a reliable mode of operation of the actuating mechanism is ensured.

A reliable mode of operation of the actuating mechanism can be ensured in that the actuating element presses on the at least one intermediate member, by which one of the clamping parts is movable or is moved towards the other clamping parts and/or by which the stop is movable or is moved.

If the holding device is equipped with an intermediate member of the type described above, it is advisable for the stop to be pivotably mounted on the intermediate member. This means that coupling of the movement of the intermediate member and of the stop is realised in a technically simple manner, in that a pivoting movement of the stop occurs upon a translational movement of the intermediate member.

According to an embodiment of the invention, provision is made for the clamping parts to be formed to be rotationally movable. This means that in each case a plurality of receptacles can be provided in the clamping parts in order to be able to accommodate pipes of different diameters therein.

For this, the clamping parts are turned to such an extent that the respective receptacles of the clamping parts face each other, and upon movement of the clamping parts towards each other the pipe to be flanged is surrounded by the two receptacles of the two clamping parts and bring about clamping. The receptacles may form for example at their one end a die for the flanging operation which is to be carried out by means of a flanging tool.

It is advisable for one of the rotationally movable clamping parts to be rotatably mounted on the intermediate member. This means that the rotational movability of the one clamping part, which has to be moved towards the other clamping part to clamp the pipe which is to be flanged, is realised in a technically simple manner. The intermediate member ensures the displacement movement of the one clamping part towards the other clamping part. By rotatably mounting the clamping part on the intermediate member, the clamping part can additionally be moved rotationally.

Advantageously, provision is made for the one of the clamping parts to be rotatably mounted on the intermediate member, and additionally for the stop to be pivotably mounted on the intermediate member. This means that the intermediate member takes on a multiple function. Owing to the displacement movement of the intermediate member, the one clamping part is moved relative to the other clamping part and additionally pivoting of the stop can take place, or the stop is pivoted away from its abutment position.

It is advisable for the axis of rotation of the one clamping part to coincide with the pivot axis of the stop. This means that the rotational movability of the clamping part and stop is made possible by means of a single axis. The mode of operation of the actuating mechanism is thereby realised with only a few components of the holding device.

Advantageously, the movement of the stop is forcibly guided relative to a section which is fixed relative to the housing. This means that it is reliably possible to prevent the stop, upon leaving its abutment position relative to the pipe which is to be flanged, from remaining in a position in which the stop would block access of the flanging tool to that end of the pipe which is to be flanged. Owing to the forcible guidance of the stop, the movement of the stop can be guided such that access to that end of the pipe which is to be flanged or the flanging die which is formed by the clamping parts is reliably unblocked.

The forcible guidance of the stop relative to a section which is fixed relative to the housing may be realised for example by a sliding-block guide. For this, provision may be made for the stop to have an elongate slot, elongated hole or a similar elongate cutout in the material, by which the stop is guided on a holding element which forms the axis of rotation of the one clamping part, such as for example locking bolts. A sliding-block guide of this type can be realised in a technically simple manner.

According to an advantageous embodiment of the invention, provision is made for the actuating element to be pivotably mounted on the housing of the holding device. This means that the actuating element can be actuated by an operator by simply pivoting it, and thus the actuating mechanism can be activated in a simple manner.

An embodiment of the invention provides for the actuating element to be formed as an eccentric lever, by which, upon pivoting from a starting position into a first position, the clamping parts are brought towards each other into a position which non-detachably holds the pipe to be flanged.

Additionally or alternatively, the actuating element which is formed as an eccentric lever, upon pivoting from the first position into a second position, can bring the clamping parts towards each other into a position which holds the pipe to be flanged counter to the force of the flanging tool.

The eccentric lever preferably has an eccentric which is manually actuated by a lever. The eccentric lever thereby permits quick clamping of the clamping parts against one another, preferably in two stages. In a first stage, the eccentric lever is pivoted into the first position and the pipe to be flanged is thereby held in the holding device. By pivoting the eccentric lever further, the clamping operation is carried on further, so that during the course of the further pivoting the second position of the eccentric lever is reached, in which the pipe to be flanged is clamped so strongly between the clamping parts that the pipe remains secured in the fastened position even when the force of the flanging tool is active.

The eccentric lever can also be designed such that even in the first position the pipe to be flanged is fastened to such an extent that the pipe also remains held between the clamping parts counter to the force of the flanging tool.

Preferably, the eccentric lever in the second position is pivoted beyond the pressure point, preferably mechanically stopped. This means that self-locking of the eccentric lever is realised, so that in the second position the eccentric lever can no longer be opened by itself. For that, a corresponding counter-acting actuating force from the operator of the holding device is then required.

According to a preferred embodiment of the invention, provision is made for the actuating element to have a grip part which is pivotable towards a grip part of the housing of the holding device. This means that the holding device can be actuated by an operator in a particularly simple manner. The holding device can also be held in one hand by the operator in a simple manner. This makes single-handed actuation of the actuating mechanism possible.

Single-handed actuation of the holding device is promoted in that, according to an embodiment of the invention, the grip parts are arranged and formed relative to each other in the manner of the grip parts of pincers. By pressing the grip parts together against one another, the actuating element can then be actuated and the clamping parts can be brought towards one another into the clamping position with respect to the pipe which is to be flanged, and preferably the stop can additionally be brought out of its abutment position relative to that end of the pipe which is to be flanged.

According to a further aspect, an embodiment of the invention relates to a flanging tool for flanging pipe ends which has a holding device of the type described above.

An embodiment of the invention makes it possible to combine the functions of holding, clamping and pivoting-in or pivoting-out of a stop for the pipe to be flanged by means of a common actuating mechanism. This means that the actuating mechanism can be actuated by an operator using a single hand. This also means that holding, clamping and alignment of the pipe which is to be flanged can be carried out in a minimum of time in a particularly user-friendly manner, so that the overall result is particularly simple manipulation of the holding device and hence of the entire flanging tool.

Further aims, advantages, features and possible applications of embodiments of the present invention will become apparent from the following description of an embodiment with reference to the drawings. In this case, all the features described and/or illustrated alone or in any meaningful combination form the subject-matter of the present invention, even regardless of how they are combined in the claims or their antecedents.

FIG. 1 shows—in a diagrammatic representation—a possible embodiment of a flanging tool 100 for flanging pipe ends. The flanging tool 100 is suitable for flanging pipes up to a wall thickness of approximately 2.0 mm, preferably pipes up to a wall thickness of approximately 1.0 mm. The pipes may be precision pipes, which consist for example of copper, brass, aluminium or steel. Pipes made of an alloy with copper, brass, aluminium or another steel alloy are also conceivable. The flanging tool 100 may be used for flanging pipes for the refrigeration and/or automobile sector. In the automobile sector, use of the flanging tool 100 is advisable for flanging brake lines.

The flanging tool 100 has a holding device 1 for holding a pipe which is to be flanged, and a flanging unit 200. The flanging unit 200 has a flanging tool which by turning a handle 210 is pressed in the direction of the end of a pipe which is chucked in the holding device 1 and widens the end of the pipe by means of deformation. Owing to the rotary movement of the handle 210 about its axis of rotation 220, the flanging tool, in addition to the feed motion in the direction of that end of the pipe which is to be flanged, is set in a rotary motion about the axis of rotation 220. The flanging tool may be formed as a cone, the centre line of which lies at an angle to the axis of rotation 220, so that a wobbling movement of the cone about the axis of rotation 220 takes place owing to the turning of the tool about the axis of rotation 220. With respect to the flanging unit 200, reference is made to the application "Device for flanging pipe ends" which was filed by the applicant on the same date as the present patent application, and the contents of which are hereby incorporated in this application.

The holding device 1 has two clamping parts 2 and 3 which are movable towards one another, between which the pipe to be flanged can be clamped. The clamping parts 2 and 3 for this purpose can be brought into a clamping position against the pipe to be flanged by means of an actuating mechanism. The actuating mechanism has an actuating element 5 which is pivotably mounted on the housing 12 of the holding device 1. On the housing 12 there is arranged, in particular formed-on, a grip part 15, by which the holding device 1 can be held in the hand by an operator.

The actuating element 5 is arranged pivotably on the housing 12 such that the actuating element 5 with a grip part 14 arranged thereon can be pivoted from an open position in the direction of the grip part 15 of the housing 12 into a closed position. The grip part 14 and the grip part 15 preferably form a configuration and arrangement in the manner of the grip parts of pincers, the grip parts 14 and 15 being able to be held in one hand by an operator, and the grip part 14 being pivotable from the open position in the direction of the grip part 15 into the closed position by single-handed operation.

Figure 2A:
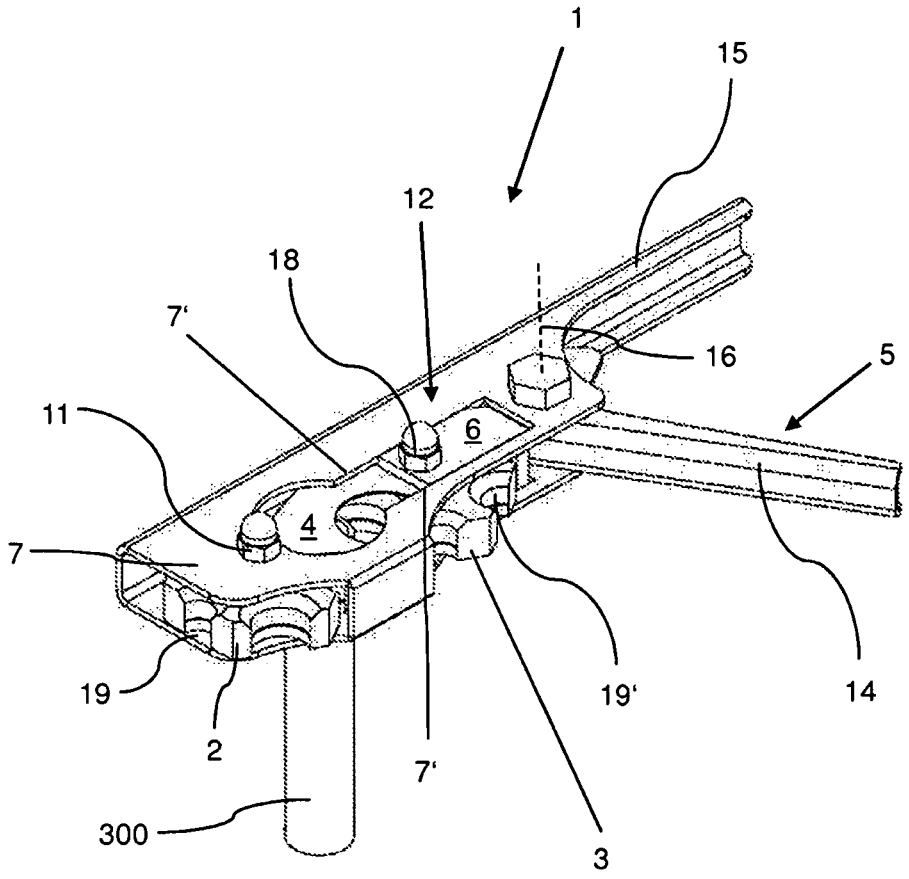
FIG. 2A and FIG. 2B shows the holding device in accordance with FIG. 1 in the opened state in a perspective view without partial section (FIG. 2A) and with partial section (FIG. 2B) of the housing of the holding device; and FIG. 3A
Figure 2B:
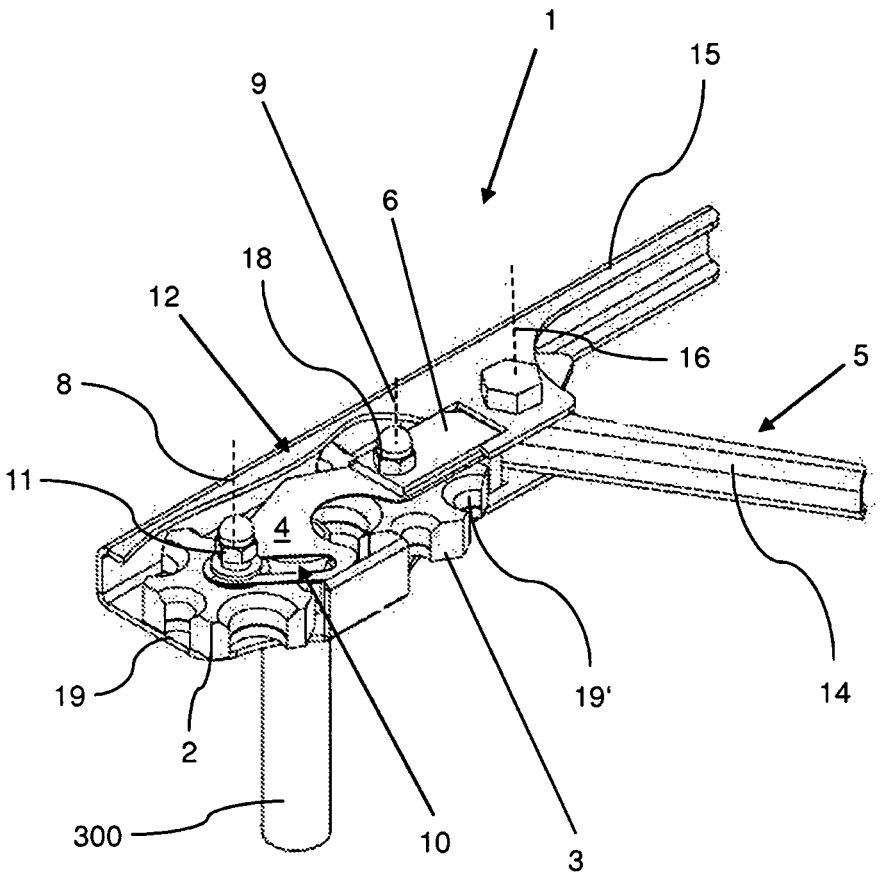

FIGS. 2A and 2B show the holding device 1 on its own with a pipe 300 which is to be flanged. The holding device 1 is illustrated in FIG. 2A in a perspective view without a partial section, and in FIG. 2B in a perspective view with a partial section through the housing 12.

In FIGS. 2A and 2B, the actuating element 5 is in the open position, i.e. pivoted away from the grip part 15 outwards about the pivot axis 16. In this position, the clamping parts 2 and 3 are moved away from each other, so that a receptacle for threading in the pipe 300 which is to be flanged is formed between the clamping parts 2 and 3.

In order to be able to move the clamping parts 2 and 3 away from each other, the one clamping part 3 is configured such that it can be displaced translationally relative to at least one section 7' of the housing 12. The other clamping part 2 is preferably held on a section 7 of the housing 12 such that it cannot be moved translationally . The translational movability of the clamping part 3 is realised by an intermediate member 6 which is forcibly guided on the section 7' of the housing 12 and against which the actuating element 5 counter-presses upon pivoting in the direction of the grip part 15.

The intermediate member 6 is preferably formed in a U-shape and encompasses the clamping part 3 with its two legs, with the base section of the intermediate member 6 which connects the legs facing towards the actuating element 5. Upon actuation of the actuating element 5, the actuating element 5 presses against the base section of the intermediate member 6, for example by means of a rotatably mounted rolling element.

The intermediate member 6 is forcibly guided in a groove on at least one wall of the housing 12, preferably the section 7' of the housing 12, with the leg of the intermediate member 6 and the groove of the housing 12 forming a sliding-block guide. For this purpose, the intermediate member 6 may be displaceable in rectilinear manner with its at least one leg in the groove of the housing 12.

As can be seen from FIGS. 2A and 2B, the holding device 1 has a stop 4, against which the pipe 300 which is to be flanged can be brought into abutment with the end thereof which is to be flanged. In the opened position of the actuating element 5 of the holding device 1, the stop 4 projects at least partially into the gap between the clamping parts 2 and 3, into which the pipe 300 which is to be flanged is to be threaded. Preferably the stop 4 projects out into the gap from the clamping part 2 which cannot be moved translationally.

The stop 4 is mounted pivotably about the pivot axis 9 on the intermediate member 6. Preferably, the stop 4 is forcibly guided relative to the housing 12, so that upon a translational movement of the intermediate member 6 in the direction of the clamping part 2 the stop 4 performs a pivoting movement outwards.

Preferably, for this purpose the stop 4 has an elongate groove 10, through which the stop 4 is displaceable on a part which is fixed relative to the housing, in particular a holding element 11, such as for example a locking bolt.

Preferably, the clamping part 2 is formed to be rotationally movable and the holding element 11 forms the axis of rotation 8 for the clamping part 2. Preferably, the clamping part 3 is further formed to be rotationally movable, the axis of rotation being formed by a holding element 18 mounted on the intermediate member 6. Preferably, the axis of rotation of the clamping part 3 at the same time forms the pivot axis 9 for the stop 4.

The clamping part 2 has a plurality of receptacles 19 arranged distributed over the periphery, which are preferably formed by substantially semicircular cutouts in the material in the clamping part 2 which are of different diameters.

Preferably the clamping part 3 also has a plurality of receptacles 19' arranged distributed over the periphery, which are preferably formed by substantially semicircular cutouts in the material which are of different diameters. The pipe 300 is encompassed by the fitting receptacle 19 of the clamping part 2 and the fitting receptacles 19' of the clamping part 3, and held in the clamping position of the clamping parts 2 and 3.

The receptacles 19, 19' have on their side facing the flanging unit 200 or on their end facing the flanging unit 200 a circumambient widened section, by which a die is formed if the receptacles 19, 19' which fit each other encompass the pipe 300.

In FIGS. 2A and 2B, the pipe 300 is already threaded into the gap between the clamping parts 2 and 3 which have been moved away from each other, and is brought with its end face into abutment against the stop 4. Preferably the pipe 300, in the threaded-in position, lies with its peripheral wall in abutment against the clamping part 2 which cannot be moved translationally, as can be seen from FIGS. 2A and 2B. The pipe 300 in the threaded-in position is not yet held between the clamping parts 2 and 3. For that, the clamping part 3 first has to be moved in the direction of the clamping part 2 and to be brought into the clamping position.

Figure 3A:
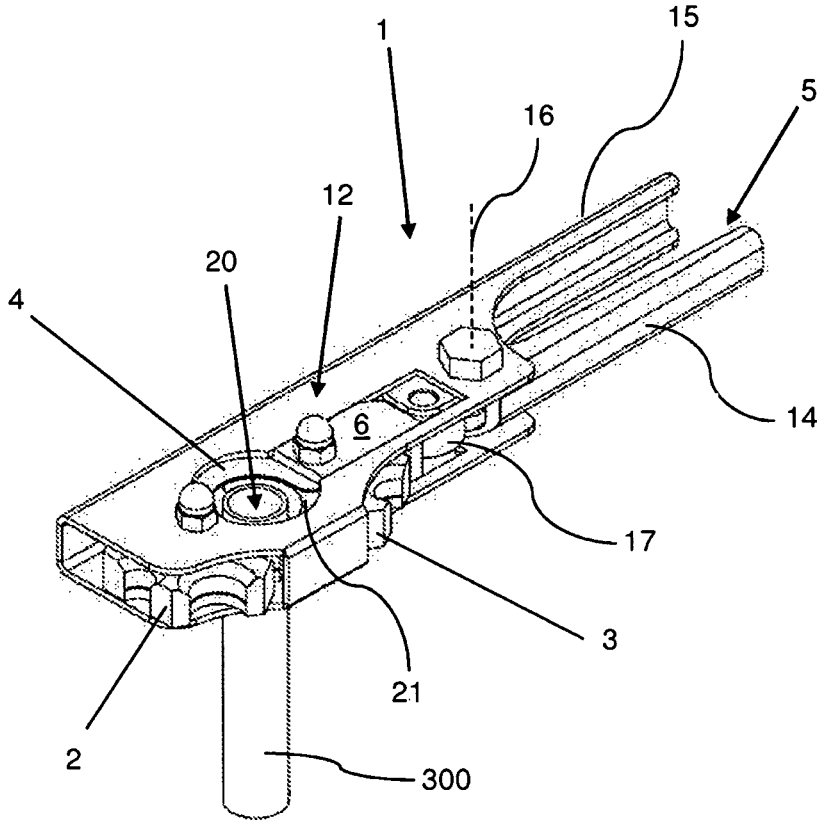
FIG. 3B shows the holding device in accordance with FIG. 1 in the closed state in a perspective view without partial section (FIG. 3A) and with partial section (FIG. 3B) of the housing of the holding device.
Figure 3B:
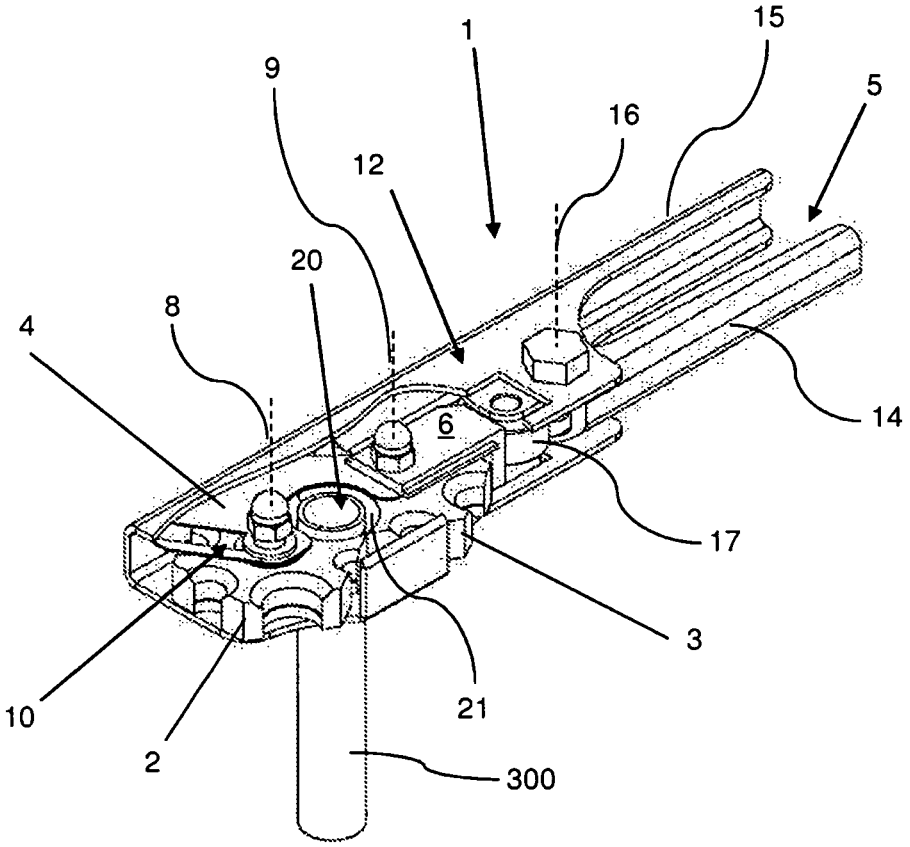

FIGS. 3A and 3B show the holding device 1 in the closed state, in which the actuating element 5 is pivoted in the direction of the grip part 15. In the closed state, the intermediate member 6 with the clamping part 3 arranged thereon is displaced in the direction of the clamping part 2, so that the pipe 300 is fastened in a receptacle 20 formed by the clamping parts 2 and 3. The receptacle 20 is widened at its end facing the flanging unit 200 and forms a die 21 for the flange at the end of the pipe 300 which is to be produced by the flanging unit.

The stop 4 is pivoted outwards, forcibly guided with its groove 10 on the holding element 11, by the displacement of the intermediate member 6 in the direction of the clamping element 2, so that in the closed position of the actuating element 5 access to that end of the pipe 300 which is to be flanged or access to the die 21 for the flanging tool is unblocked.

Preferably, the stop 4 has the peripheral contour of the die 21, in particular the stop 4 is formed, at least over a section, in the manner of a circle or a segment of a circle, so that even upon a slight pivoting movement of the stop 4 outwards, access to the die 21 or that end of the pipe which is to be flanged is unblocked.

In the embodiment of the holding device 1 in accordance with FIGS. 1 to 3B, the actuating element 5 is formed as an eccentric lever, the lever of the eccentric lever being formed by the grip part 14. By actuating the actuating element 5 from the open state in the direction of the closed state of the holding device 1, the rolling element 17 which is arranged at the one end of the eccentric lever comes into abutment against the intermediate member 6 and presses the intermediate member 6 in the direction of the clamping part 2. The pipe 300 to be flanged is thereby clamped between the clamping parts 2 and 3 to such an extent that the pipe is held at least non-detachably in the threaded-in position. By further pivoting of the actuating element 5 in the direction of the grip part 15, the rolling element 17 comes into a position in which the rolling element 17 is pivoted out somewhat beyond the the pivot axis 16 of the actuating element 5, and as a result the actuating element 5 reaches a locking position in which self-locking of the actuating element 5 against opening is achieved (FIGS. 3A and 3B). In this position, such a high pressure force is transmitted to the clamping part 3 by the actuating element 5 via the intermediate member 6 that such clamping is imparted to the pipe 300 between the clamping parts 2 and 3 that the pipe 300 is fastened counter to the force of the flanging tool.

The actuating element 5 which is formed as an eccentric lever is preferably formed on its eccentric section such that the eccentric section in the closed position of the actuating element comes into abutment against the housing 12 of the holding device 1 in the active position. Preferably, in this position the grip parts 14 and 15 lie opposite one another substantially parallel to each other.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise.

LIST OF REFERENCE NUMERALS

1 holding device
2 clamping part
3 clamping part
4 stop
5 actuating element, eccentric lever
6 intermediate member
7 section fixed relative to the housing
7' section fixed relative to the housing
8 axis of rotation
9 pivot axis
10 groove
11 holding element
12 housing
14 grip part
15 grip part
16 pivot axis
17 rolling element
18 holding element
19 receptacle
19' receptacle
20 receptacle
21 die
100 flanging tool
200 flanging unit
210 handle
220 axis of rotation
300 pipe to be flanged

The invention claimed is:

1. A holding device for a flanging tool, the holding device comprising:

two clamping parts movable towards one another to respective clamping positions;

a stop configured to abut, in an abutment position, an end of a pipe to be flanged; and an actuating mechanism configured to move the clamping parts into the respective clamping positions so as to clamp the pipe to be flanged, the actuating mechanism being coupled to the stop such that actuation of the actuating mechanism moves the stop out of the abutment position, wherein the actuating mechanism is configured to cause, in response to a single pivoting motion applied thereto, both movement of the clamping parts into their respective clamping positions and movement of the stop out of the abutment position.

2. The holding device according to claim 1, wherein the clamping parts form a female mould for the end of the pipe to be flanged, access to the female mould being unblocked by the stop in the clamping positions of the clamping parts.

3. The holding device according to claim 1, wherein the stop is in an operative connection with at least one of the clamping parts such that a movement of the clamping parts towards one another at least partially moves the stop.

4. The holding device according to claim 1, wherein one of the clamping parts is movable translationally relative to a section that is fixed relative to a housing of the holding device.

5. The holding device according to claim 4, wherein the clamping part that is translationally movable is forcibly guidable on the section that is fixed relative to the housing.

6. The holding device according to claim 4, wherein the stop is pivotably mounted on the clamping part that is translationally movable.

7. The holding device according to claim 1, wherein the actuating mechanism has a manually-operated actuating element configured to act on at least one of the clamping parts or the stop.

8. The holding device according to claim 7, wherein the stop and at least one of the clamping parts cooperate with the actuating element via at least one common intermediate member.

9. The holding device according to claim 8, wherein the stop is pivotably mounted on the intermediate member.

10. The holding device according to claim 8, wherein the intermediate member is movable translationally relative to a section of a housing of the holding device.

11. The holding device according to claim 1, wherein the stop and at least one of the clamping parts cooperate with the actuating mechanism via at least one common intermediate member, the clamping parts being rotationally movable and one of the clamping parts being rotatably mounted on the intermediate member.

12. The holding device according to claim 11, wherein the clamping part rotatably mounted on the intermediate member has an axis of rotation that coincides with a pivot axis of the stop.

13. The holding device according to claim 1, wherein the stop has an elongated slot, an elongated hole, or a similar elongated cutout in the material, by which the stop is guidable on a locking bolt which forms an axis of rotation of one of the clamping parts.

14. The holding device according to claim 7, wherein the actuating element is pivotably mounted on a housing of the holding device.

15. The holding device according to claim 14, wherein the actuating element is an eccentric lever pivotable from a starting position into a first position by which the clamping parts are brought towards one another into positions which non-detachably hold the pipe to be flanged.

16. The holding device according to claim 15, wherein the actuating element is pivotable from the first position into a second position by which the clamping parts are brought towards one another into positions which hold the pipe to be flanged counter to a force of the flanging tool.

17. The holding device according to claim 7, wherein the actuating element has a grip part which is pivotable against a grip part of a housing of the holding device.

18. The holding device according to claim 1, wherein the actuating mechanism includes a lever pivotable along the single pivot axis; and wherein a motion of the lever in a single direction along the single pivot axis causes the clamping parts to move into their respective clamping positions and simultaneously causes the stop to move out of the abutment position.

19. A flanging tool for flanging pipe ends, the flanging tool comprising:

a holding device comprising:

two clamping parts movable towards one another to respective clamping positions;

a stop configured to abut, in an abutment position, an end of a pipe to be flanged; and an actuating mechanism configured to move the clamping parts into the respective clamping positions so as to clamp the pipe to be flanged, the actuating mechanism being coupled to the stop such that actuation of the actuating mechanism moves the stop out of the abutment position, wherein the actuating mechanism is configured to cause, in response to a single pivoting motion applied thereto, both movement of the clamping parts into their respective clamping positions and movement of the stop out of the abutment position.

20. A holding device for a flanging tool, the holding device comprising:

two clamping parts movable towards one another to respective clamping positions;

a stop configured to abut, in an abutment position, an end of a pipe to be flanged; and an actuating mechanism configured to move the clamping parts into the respective clamping positions so as to clamp the pipe to be flanged, the actuating mechanism being coupled to the stop such that actuation of the actuating mechanism moves the stop out of the abutment position, wherein the stop is configured as a flat slider, and wherein the actuating mechanism is configured to cause, in response to a single pivoting motion applied thereto, both movement of the clamping parts into their respective clamping positions and movement of the stop out of the abutment position.

* * * * *